US007743720B1

(12) United States Patent
Salani

(10) Patent No.: US 7,743,720 B1
(45) Date of Patent: Jun. 29, 2010

(54) MULTIHULL HYDROFOIL WATERCRAFT

(76) Inventor: Steven John Salani, P.O. Box 1434, El Segundo, CA (US) 90245

( * ) Notice: Subject to any disclaimer, the term of this patent is extended or adjusted under 35 U.S.C. 154(b) by 0 days.

(21) Appl. No.: 11/983,243

(22) Filed: Nov. 8, 2007

Related U.S. Application Data

(60) Provisional application No. 60/857,720, filed on Nov. 8, 2006.

(51) Int. Cl.

| | |
|---|---|
| ***B63B 1/00*** | (2006.01) |
| ***B63B 1/10*** | (2006.01) |
| ***B63B 1/14*** | (2006.01) |
| ***B63B 1/24*** | (2006.01) |
| ***B63B 1/28*** | (2006.01) |
| ***B63B 39/00*** | (2006.01) |
| ***B63B 39/06*** | (2006.01) |

(52) U.S. Cl. ..... 114/61.1; 114/39.26; 114/39.28; 114/61.15; 114/122; 114/126; 114/275; 114/279; 114/280; 114/283; 114/284

(58) Field of Classification Search ... 114/39.26–39.28, 114/61.1–61.19, 122, 126, 271, 274–287, 114/292

See application file for complete search history.

(56) References Cited

U.S. PATENT DOCUMENTS

| | | | | | |
|---|---|---|---|---|---|
| 2,387,907 | A | * | 10/1945 | Hook | 114/276 |
| 2,709,979 | A | * | 6/1955 | Bush et al. | 114/277 |
| 3,092,062 | A | * | 6/1963 | Savitsky | 114/277 |
| 3,149,602 | A | * | 9/1964 | Vogt | 114/276 |
| 3,762,353 | A | * | 10/1973 | Shutt | 114/39.24 |
| 3,812,806 | A | * | 5/1974 | Korotkov et al. | 114/275 |
| 4,711,195 | A | * | 12/1987 | Shutt | 114/274 |
| 5,168,824 | A | * | 12/1992 | Ketterman | 114/276 |

* cited by examiner

*Primary Examiner*—Ajay Vasudeva

(57) ABSTRACT

A multihull hydrofoil watercraft incorporates a stabilization system wherein the buoyancy of the hulls is used as a sensing and control mechanism for the hydrofoils. The use of hull buoyancy to adjust the hydrofoil lift provides for automatic control of altitude, pitch and roll, and allows the craft to accommodate varying weather and sea conditions while providing a smooth ride for passengers. The stabilization technique eliminates the need for extraneous sensing mechanisms placed in or on the water surface which are subject to fouling, damage, or disruption by localized surface disturbances.

12 Claims, 4 Drawing Sheets

MULTIHULL HYDROFOIL WATERCRAFT

CROSS REFERENCE TO RELATED APPLICATIONS

This application claims priority to provisional case 60/857,720 filed Nov. 8, 2006

BACKGROUND OF THE INVENTION

The development of the hydrofoil lifting device has the potential to greatly advance the performance of watercraft. Both powered and sail craft may benefit from the application of the hydrofoil device. These performance enhancements have been limited by difficulties associated with the hydrofoil control mechanisms. Previous applications of hydrofoils to sailcraft have also been limited in that the designs were effective only in high wind conditions.

For large powered watercraft, fully electronic control mechanisms have been developed to optimize performance and stability under varying weather and sea conditions. For smaller powered vessels, or for sail boats in particular, the power consumption, weight, and complexity of fully electronic control systems is not as practical. The present invention offers many of the advantages of an electronic control system with a much simpler design, suitable for use even in small power or sailboats.

Previous designs for hydrofoil craft have not fully addressed all the requirements for a control system that accommodates varying weather, sea, and load conditions. One such design (U.S. Pat. No. 6,578,507 to Bergmark) employs hydrofoil devices intended to counteract the heeling force of the wind against the sail. The design does not address altitude stabilization or automatically adjust for changing wind conditions or sail trim ("the wings may be actuated by means of control means that are accessible from the cockpit)".

In a similar U.S. patent (Baulard-Caugan U.S. Pat. No. 4,385,579) hydrofoil-like devices are linked to the mast to provide some means of compensating for wind variations. This design improves roll stabilization but does not exploit the lifting potential of the hydrofoils to reduce hull drag, nor does it attempt to control the altitude of the craft.

U.S. Pat. No. 3,762,353 (Shutt) is also designed primarily to counteract the heeling force exerted by the sail/mast. The hydrofoil's angle of attacked is controlled by a small float assembly linked to the main hull. This design does not exploit the lifting potential of the hr drofoil, and is also very susceptible to localized variations in wave height that could adversely affect stability.

The catamaran stabilization structure of U.S. Pat. No. 4,561,371 (Kelley et al) employs passive wing structures whose angle of attack is fixed and therefore do not adjust to accommodate changing conditions.

In U.S. Pat. No. 5,168,824 (Ketterman) the hydrofoil control mechanism also makes use of a small "canard" on the water surface near the foil. To reduce susceptibility to localized wave action, a flexible linkage absorbs higher-frequency variations in canard height. The rudder foil does not employ the canard control mechanism, and is therefore less effective in counteracting any pitching motion that may be induced by wind/wave interaction. The canard mechanisms on the lateral foils may also be susceptible to swamping by large waves which could destabilize the craft.

The present invention uses a foil control mechanism which addresses many of the problems of prior designs, while adding additional benefits. Rather than using localized float sensing mechanisms, the new design controls the foils based on the buoyancy along the entire length of two or more hulls. This method minimizes any disturbance from localized wave action and automatically compensates against heeling, pitch, and roll. The buoyancy provided by the hulls combines with the hydrodynamic force from the foils, so that performance is improved even for a sailcraft in low wind conditions.

SUMMARY OF THE INVENTION

In a catamaran configuration, the preferred embodiment of the invention uses two hydrofoils per hull, located on vertical struts near the forward and aft ends of the hull. The struts are rigidly fixed to a deck structure that supports the two hulls.

The key to the design is the mechanical decoupling of the hulls from the deck structure. The hulls are allowed a small range of vertical motion relative to the struts and the deck structure. This motion is constrained by springs, pads, or other compressible elements. The vertical motions of the hulls (relative to the rest of the boat) are then linked to the foils to vary the hydrodynamic lift and thereby stabilize the craft under a wide range of wind and ocean conditions. The adjustment of a foil's hydrodynamic lift is typically accomplished by varying the foil's angle of attack, although other methods may be used to accomplish the same result.

At rest, the weight of the boat is supported entirely by the buoyancy of the hulls. The control mechanism in this state places the foils at angle of attack such that lifting forces will be generated as soon as the boat gains forward motion.

As the boat picks up speed, the lifting force contributed by the foils will increase, causing the boat to move higher in altitude with respect to the ocean surface. At the same time, the lifting force contributed by the hulls will decrease as they are raised higher out of the water. The control mechanism will sense this shift in load on the hulls, and begin to decrease the angle of attack on the foils. At a point where the hulls are almost clear of the water the control system will achieve equilibrium, and the boat will continue to move forward with greatly reduced hull drag.

A conventional catamaran design is subject to capsize under certain extreme conditions. High winds can generate heeling (tipping) forces strong enough to lift one hull of a multi-hull sailboat completely out of the water. In a powered catamaran, this risk occurs during highspeed turns in a tight radius. If not controlled, these forces can cause a capsize.

The current design minimizes the risk of capsize in both powered and sail craft. If a hull is lifted past the control mechanism's equilibrium point, the angle of attack on the foils will be reversed to provide negative lift to counteract the heeling force. This allows safe operation at higher speeds than would be possible in a conventional multihull craft.

The catamaran configuration may alternately use one controlled foil at the bow of each hull, and a fixed (non-adjustable) hydrofoil at the stern. This does not provide all the benefits of using two controlled foils per hull, but the cost and complexity of the craft is reduced.

A trimaran embodiment is similar to the z-hull discussed above, with the addition of a center hull. The control mechanisms in the outside hulls' hydrofoil assemblies regulate the boat's altitude and reduce risk of capsize in the same manner as the catamaran configuration.

Is it clear that the principles and benefits of the present invention may be applied as well to vessels with more than three hulls.

To accommodate varying sea states the control system includes adjustable dampers that control the response time to changes in hull buoyancy. Thus the system can be tuned to provide the most comfortable and safe ride for the passengers.

DETAILED DESCRIPTION OF THE INVENTION

Figure 1:
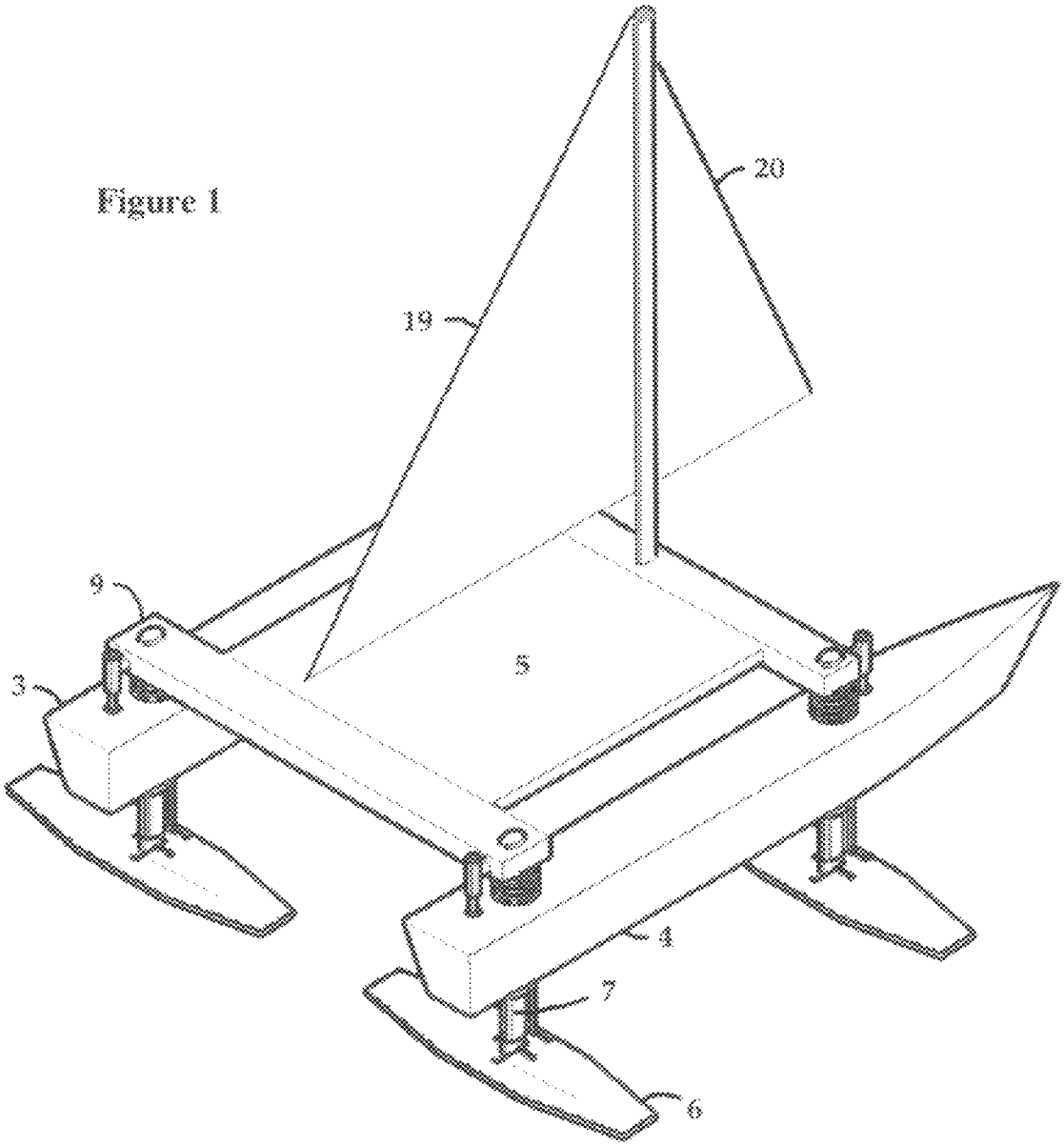
FIG. 1 is a perspective view of a hydrofoil watercraft with sails in the catamaran (twin-hull) configuration. Four hydrofoils provide hydrodynamic lift when the boat has forward momentum.

FIG. 1 illustrates the preferred embodiment of the preset invention in a catamaran sailboat configuration. Twin hulls 3 and 4 are connected via a deck structure 5 that accommodates passengers, equipment, and supplies. Cross beams 9 may be present to add strength and rigidity to the deck structure, but are not an essential element of the invention. A typical sail configuration will include a main sail 19 and jib 20, although any desired sail configuration is compatible with the present invention. A hydrofoil 6 is mounted near the forward and aft end of each hull, supported by a vertical strut 7.

Figure 2:
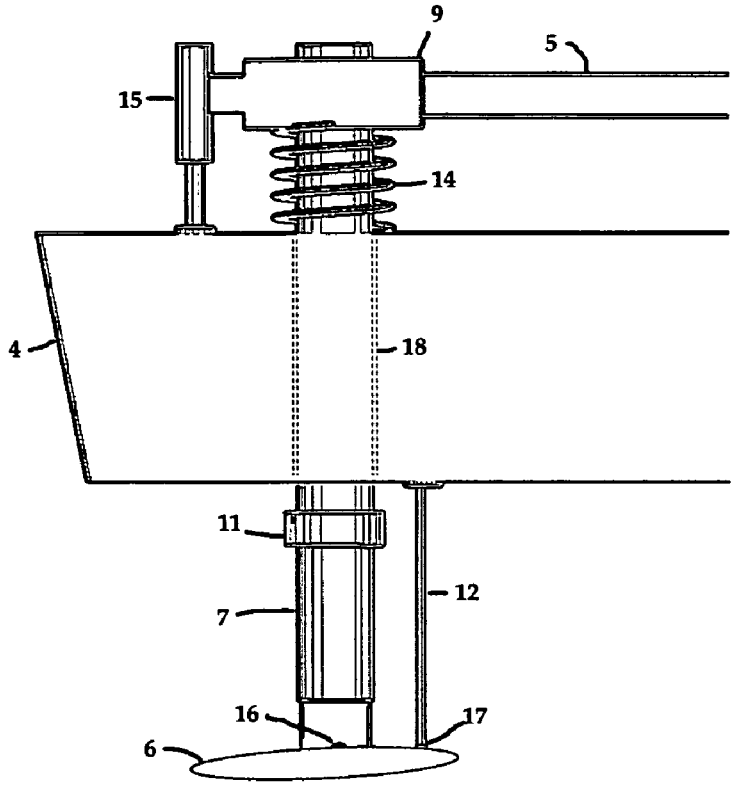
FIG. 2 is a detailed side view that illustrates the control mechanism employed on each of the hydrofoil assemblies.

FIG. 2 is a detailed side view of the hydrofoil support and control mechanism. Each hydrofoil 6 is mounted on a pivot 16 which allows the foil's angle of attack to be adjusted by a control rod 12 attached to the foil at a pivot point 17. For illustration purposes the control rod is shown outside of the strut, but in practice could be enclosed within the strut to reduce drag as the boat moves through the water.

The upper end of the control rod is attached to the hull 4. The hydrofoil element 6 is supported by a vertical strut 7 affixed rigidly to the deck structure 5. The strut is mounted through a hollow sleeve 18 embedded in the hull. The sleeve allows the hull to move up and down relative to the deck structure 5, strut 7, and hydrofoil 6. The upward motion of the hull is constrained by a spring 14. The downward hull motion is constrained by a limiter 11.

At rest in the water, the hull 4 provides an upward buoyant force to support the weight of the boat. This force compresses the spring 14 causing the hull to move upward towards the deck structure 5 until the buoyant force of the hull matches the compression force of the spring. The upward movement of the hull also causes the hydrofoil 6 to swing upward by way of control rod 12 to a positive angle of attack.

In an ocean breeze the boat will begin to move forward as the sails are raised and trimmed. As the forward momentum increases, hydrofoil 6 will begin to generate lift, causing the boat to gain altitude above the ocean surface. As the hydrodynamic force contributed by the foil continues to increase, the hull contributes a correspondingly smaller portion of the total lifting force, therefore the hull 4 will start to slide downward on the strut 7. The farther the boat lifts out of the water, the lower the resulting hull position on the strut. As the hull drops, the hydrofoil angle of attack is automatically decreased via control rod 12. Eventually, as the lifting force contributed by the hull approaches zero, the hydrofoil angle of attack will decrease to the point that the boat altitude stabilizes.

If the wind on the sails is strong enough, the windward hull of a conventional catamaran will tend to lift out of the water completely, which could lead to a dangerous capsize. With the present invention, this heeling (tipping) force will be counteracted automatically by the control mechanism. The length of the control rod is set so that if the hull slides too far down the strut, the hydrofoil angle of attack will change to negative, causing a negative lifting force to counteract the heeling moment caused by the sails. The hull will be in minimal contact with the surface but the control mechanism will not allow the hull to "fly" or leave the surface completely, thereby avoiding the risk of capsize.

In a powered watercraft the heeling force is not generated by a sail, but rather by forces encountered when executing tight-radius turns at high speed. The control mechanism of the present mechanism serves to counteract this heeling moment in the same manner as described for the sail-powered craft; the hull always stays in minimal contact with the surface. This characteristic is one of the most valuable advantages of the present invention, as it improves both performance and safety for sail or power boats alike.

A shock absorbing device 15 is employed at the end of each hull to dampen the control mechanism for smooth operation. The preferred embodiment will use a gas or liquid filled linear damper (readily available from industrial suppliers) as the shock absorbing device. The linear damper typically provides an adjustable damping coefficient, which can be used to trim the response to accommodate various sea states.

In a sea condition of short choppy waves, a high degree of damping will prevent the chop from causing vibration or oscillations as the mechanism adjusts. In a sea state with long, high swell, a lower amount of damping will allow the boat to follow the altitude contour of the swell. This reduces wave collisions which drastically impede the forward motion of the boat.

Additional Embodiments

Figure 3:
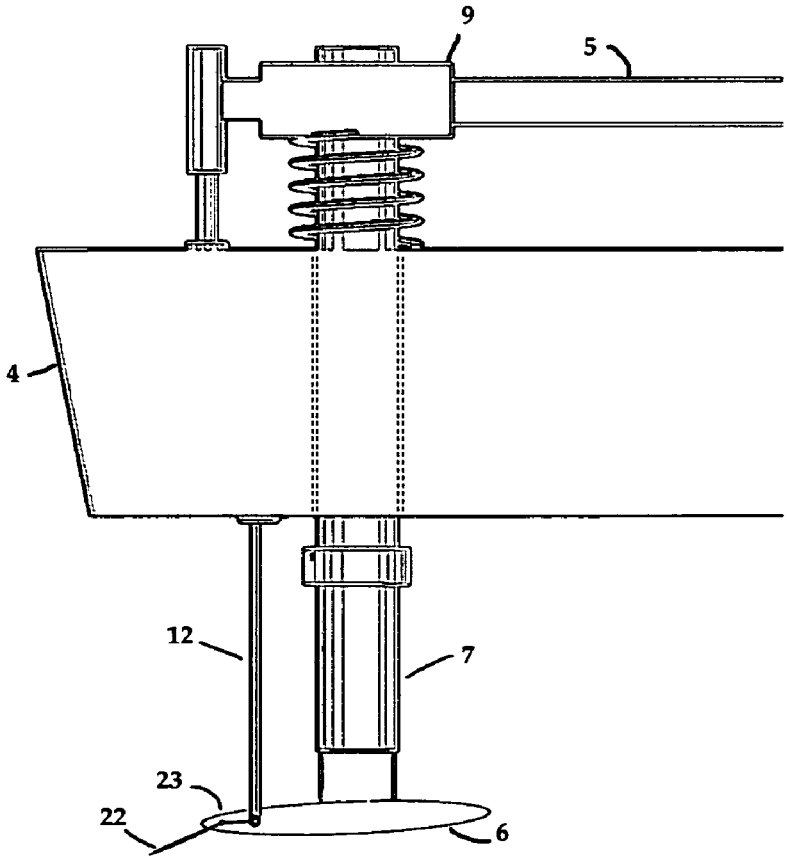
FIG. 3 is a detailed side view that illustrates an alternate embodiment of the control mechanism employed on each of the hydrofoil assemblies

There are numerous well-known mechanisms for adjusting the lift generated by a hydrofoil. Changing the foil's angle of attack as discussed above is the simplest mechanism. An alternate approach utilizes adjustable flaps on the trailing edge of the foil, similar to those used on airliners. FIG. 3 shows an embodiment of the invention using a trailing edge flap. The hydrofoil 6 in this instance is rigidly fixed to the strut 7. The control rod 12 connects to the flap 22 which is free to rotate about the pivot point 23. The net effect of this arrangement is the same as the previous embodiment. As the hull moves downward, control rod 12 causes the flap 22 to rotate clockwise about pivot point 23. As the active surface of the flap moves upward, the lift generated by the hydrofoil decreases proportionally.

Figure 4:
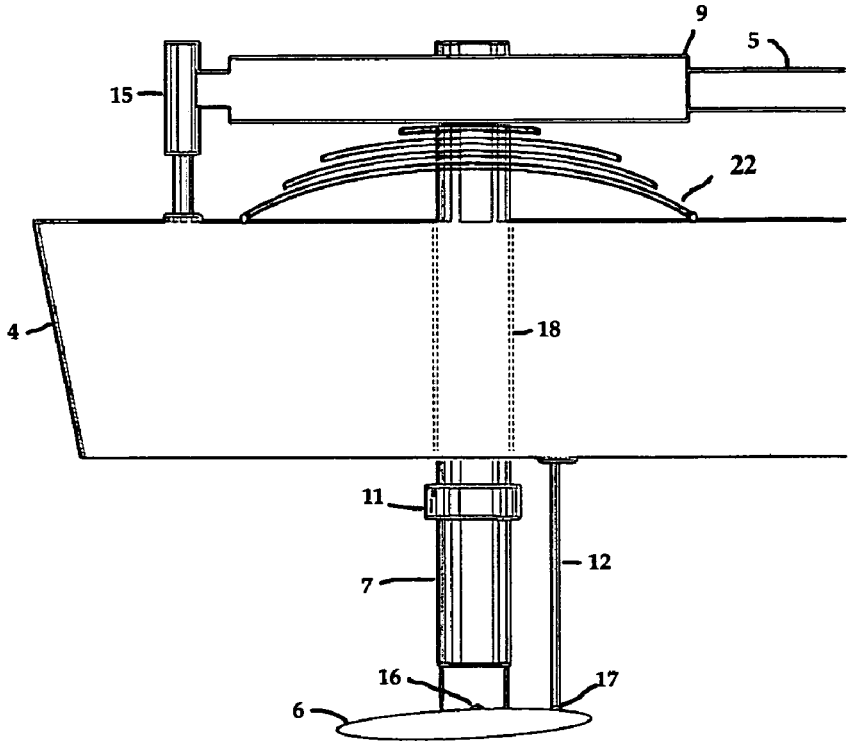
FIG. 4 is a detailed side view that illustrates an alternate embodiment of the control mechanism using a leaf spring instead of a coil spring.
Figure 5:
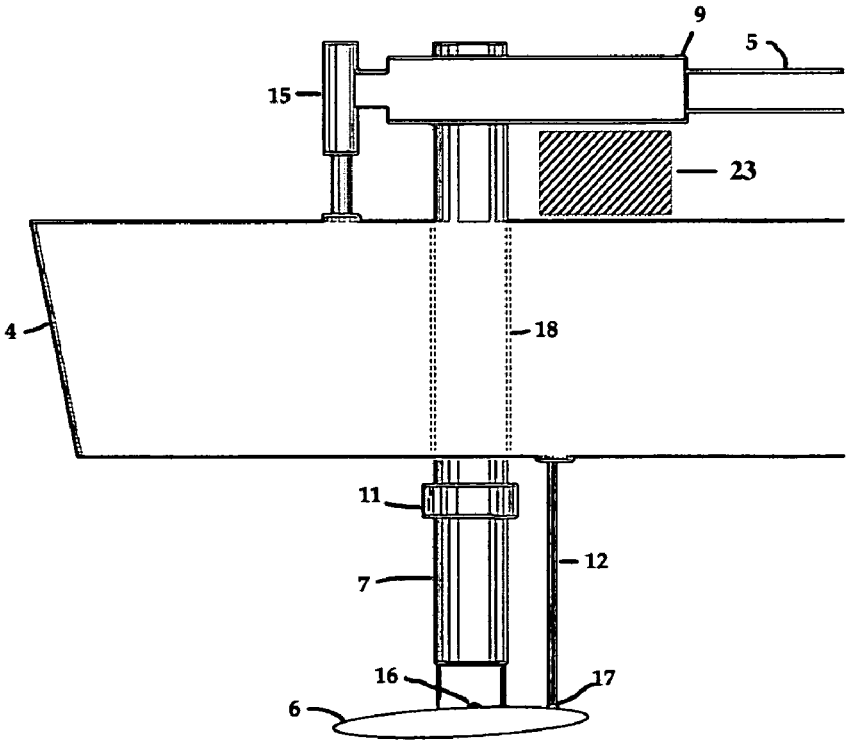
FIG. 5 is a detailed side view that illustrates an alternate embodiment of the control mechanism using a compressible pad instead of a spring

FIG. 4 illustrates an alternate embodiment wherein the spring element 14 is replaced by a functionally-equivalent device such as a leaf spring 22. FIG. 5 illustrates a functionally-equivalent implementation using a compressible pad 23 instead of a spring. The pad will resist compression with a force proportional to distance in the same manner as a coil or leaf spring.

Figure 6:
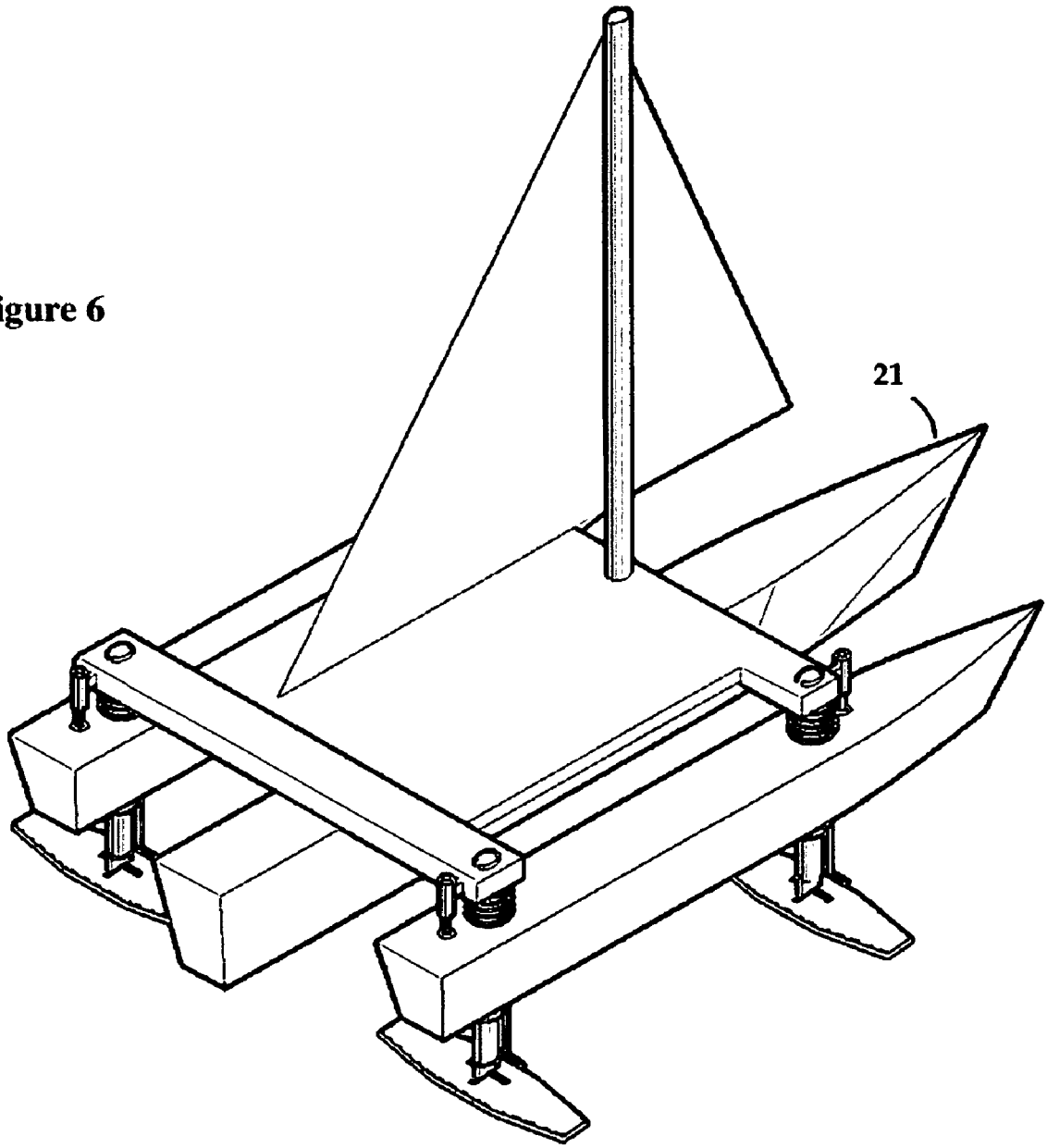
FIG. 6 is a perspective view of a hydrofoil watercraft in a trimaran (3-hull) configuration. All elements of this drawing are the same as in FIG. 1 except for the addition of the center hull.

FIG. 6 illustrates the invention in a trimaran (3-hull) configuration. All elements in the figure are identical to FIG. 1 except for the additional hull 21. The principle of operation is the same as discussed in the catamaran embodiment above. The trimaran (or any other configuration with 3 or more hulls) may optionally be configured so that the outside hulls equipped with hydrofoil assemblies are positioned lower than the interior hull(s). At higher speeds this will allow the interior hull(s) to clear the water completely, reducing drag and increasing speed.

CONCLUSION

The invention discloses a multihull watercraft with automatic control of altitude, pitch and roll, which is able to accommodate varying weather and sea conditions while providing a smooth ride for passengers. These benefits are obtained without the cost, complexity, and reliability issues of an electronic control system.

Variations to the embodiments shown may be implemented that are functionally equivalent to the invention disclosed here. The hydrofoil lift may alternately be adjusted using equivalent methods, such as changing the camber (shape) of a flexible hydrofoil. Any of the well-known motion damping devices may be substituted for the shock absorber 15, including linear dampers filled with a gas or liquid. The function of the control rod 12 to link the hull movement to the foil adjustment may be provided by many other well-known linkage means, including flexible cables, hydraulic lines, or servo-electric devices. Many well-known mechanisms including roller bearings, ball bearings, or swing arms may be used in place of the sleeve 18 to allow vertical motion of the hulls relative to the deck structure.

Thus the scope of the invention is defined not by the embodiments presented but by the attached claims.

The invention claimed is:

1. A hydrofoil-equipped multi-hull watercraft comprising:

two or more buoyant hulls supporting a deck structure above water, said hulls vertically moveable relative to said deck structure to correspondingly vary a spacing between said hulls and said deck structure;

one or more hydrofoils attached to said deck structure, said hydrofoils being adjustably mounted to vary the lifting force generated by said hydrofoils when said watercraft is in motion; and a linkage extending substantially vertically between each of said hulls and respective one of said hydrofoils, wherein an increase in the spacing between any one of said hulls and said deck structure reduces the lifting force generated by said one or more hydrofoils, thereby regulating the altitude of said watercraft and minimizing pitching and rolling.

2. The watercraft of claim 1 wherein the lifting force generated by said hydrofoils may be increased or reduced by changing the hydrofoil's angle of attack.

3. The watercraft of claim 1 wherein the lifting force generated by said hydrofoils may be increased or reduced by changing the angle of a flap element at the trailing edge of the hydrofoil.

4. The watercraft of claim 1 wherein said hulls are attached to said deck structure using one or more vertical struts which pass through hollow sleeves embedded in the hulls, therefore allowing vertical hull motion relative to the deck structure.

5. The watercraft of claim 1 wherein said linkage is a mechanical linkage, and wherein said vertical motion of said hulls adjusts the lifting force of said hydrofoils using said mechanical linkage to the hydrofoils.

6. The watercraft of claim 5 wherein said mechanical linkage is a rigid control rod.

7. The watercraft of claim 1 wherein the motion of said hulls relative to said deck structure is constrained using a coil spring, with one end of the coil spring attached to the deck structure and the other end of the coil spring attached to the hull.

8. The watercraft of claim 1 wherein the motion of said hulls relative to said deck structure is constrained using a leaf spring connecting the hull and deck structure.

9. The watercraft of claim 1 wherein the motion of said hulls relative to said deck structure is constrained using a compressible pad, with said pad mounted between the hull and the deck structure.

10. The watercraft of claim 1 wherein the motion of said hulls relative to said deck structure is dampened by a gas-filled shock absorber or linear damper with adjustable damping coefficient to minimize oscillations in boat amplitude and adjust for varying sea states.

11. The watercraft of claim 1 wherein the motion of said hulls relative to said deck structure is dampened by a liquid-filled shock absorber or linear damper with adjustable damping coefficient to minimize oscillations in boat amplitude and adjust for varying sea states.

12. The watercraft of claim 1 wherein said two or more buoyant hulls comprise at least three hulls, and wherein at least one inside hull of said at least three hulls is positioned higher than the outside hulls, so that as the watercraft gains speed and altitude above the ocean surface said at least one higher inside hull is raised completely out of the water to reduce drag and increase speed.

* * * * *